US012092367B2

(12) United States Patent
Couapel et al.

(10) Patent No.: US 12,092,367 B2
(45) Date of Patent: Sep. 17, 2024

(54) ELECTRIC HEATING DEVICE WITH ELECTRODE HOUSING STATION

(71) Applicant: Valeo Systemes Thermiques, Le Mesnil-Saint-Denis (FR)

(72) Inventors: Yann Couapel, Le Mesnil Saint Denis (FR); Erwan Gogmos, Le Mesnil Saint Denis (FR)

(73) Assignee: VALEO SYSTEMES THERMIQUES, Le Mesnil-Saint-Denis (FR)

( * ) Notice: Subject to any disclaimer, the term of this patent is extended or adjusted under 35 U.S.C. 154(b) by 1097 days.

(21) Appl. No.: 16/766,896

(22) PCT Filed: Dec. 13, 2018

(86) PCT No.: PCT/FR2018/053250
§ 371 (c)(1),
(2) Date: May 26, 2020

(87) PCT Pub. No.: WO2019/122616
PCT Pub. Date: Jun. 27, 2019

(65) Prior Publication Data

US 2020/0309410 A1 Oct. 1, 2020

(30) Foreign Application Priority Data

Dec. 19, 2017 (FR) ..... 1762533

(51) Int. Cl.
*F24H 3/04* (2022.01)
*F24H 9/00* (2022.01)
*F24H 9/1863* (2022.01)

(52) U.S. Cl.
CPC ..... *F24H 3/0441* (2013.01); *F24H 9/0063* (2013.01); *F24H 9/1863* (2013.01); *F24H 2250/10* (2013.01)

(58) Field of Classification Search
None
See application file for complete search history.

(56) References Cited

U.S. PATENT DOCUMENTS

20 A * 8/1836 Duchman ..... B68C 1/14
236/1 R
6,729,388 B2 * 5/2004 Emrich ..... F28D 1/05366
165/181
9,234,677 B2 * 1/2016 Clade ..... F24H 3/0435
(Continued)

FOREIGN PATENT DOCUMENTS

CN 1510728 A 7/2004
CN 101097092 A 1/2008
(Continued)

OTHER PUBLICATIONS

International Search Report and Written Opinion in corresponding International Application No. PCT/FR2018/053250, mailed Apr. 10, 2019 (13 pages).
(Continued)

*Primary Examiner* — Thor S Campbell
(74) *Attorney, Agent, or Firm* — Osha Bergman Watanabe & Burton LLP

(57) ABSTRACT

Heating device 1 for an air conditioning unit, the said heating device 1 comprising a heating body 2 powered with current via a distribution unit 3 to heat a flow of air passing through the said heating body 2, the heating body 2 comprising an alignment of tubes 4 in which there are: —heating elements 8 through which the said current passes; —electrodes 9 situated on each side of the heating elements 8 in order to supply them with electrical current. This heating device 1 is characterised in that the distribution units 3 comprises an electrode housing station 6 housing the electrodes 9, the said housing station 6 having a plurality of housings 17 to house the electrodes 9 and in which there are
(Continued)

Figure 1:
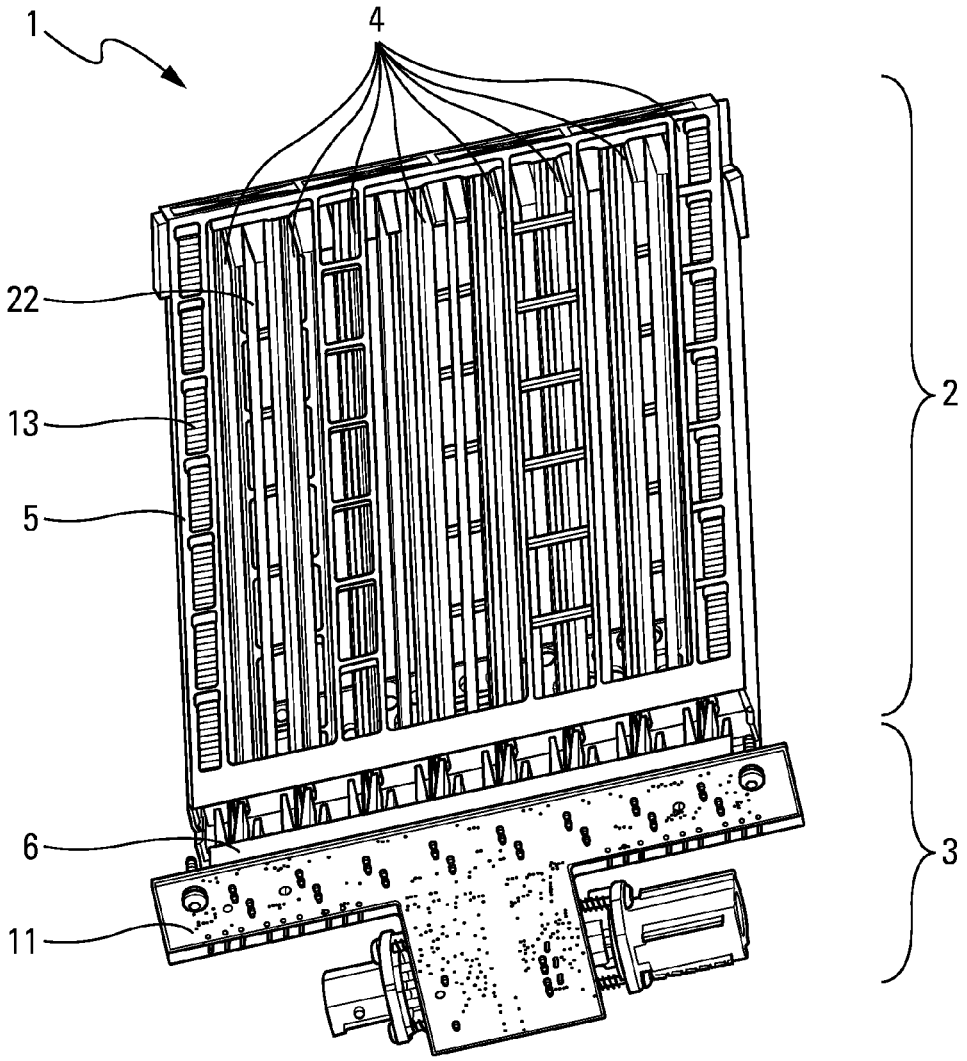

means for mechanically and electrically connecting the electrodes 9 to the distribution unit 3.

15 Claims, 6 Drawing Sheets

(56) References Cited

U.S. PATENT DOCUMENTS

| | | | | |
|---|---|---|---|---|
| 10,616,959 | B2 * | 4/2020 | Kohl | H05B 3/50 |
| 2005/0205552 | A1 * | 9/2005 | Han | F24H 3/0405 219/540 |
| 2008/0000889 | A1 * | 1/2008 | Niederer | F24H 3/082 219/205 |
| 2011/0180617 | A1 * | 7/2011 | Saito | F24H 9/1872 236/49.3 |
| 2012/0085742 | A1 * | 4/2012 | Niederer | F24H 15/335 219/385 |
| 2012/0087642 | A1 * | 4/2012 | Bohlender | F24H 9/2028 392/465 |
| 2014/0319114 | A1 * | 10/2014 | Gong | F24H 3/0405 219/202 |
| 2023/0182536 | A1 * | 6/2023 | Buerck | F24H 3/0429 392/480 |

FOREIGN PATENT DOCUMENTS

| | | | |
|---|---|---|---|
| CN | 104798259 | A | 7/2015 |
| CN | 105165114 | A | 12/2015 |
| CN | 107264231 | A | 10/2017 |
| CN | 206556229 | U | 10/2017 |
| CN | 111742183 | A | 10/2020 |
| EP | 3228950 | A1 | 10/2017 |
| FR | 3032388 | A1 | 8/2016 |
| JP | 2000-168345 | A | 6/2000 |
| JP | 2005-085697 | A | 3/2005 |
| JP | 2008-007106 | A | 1/2008 |
| WO | 2007/129608 | A1 | 11/2007 |
| WO | 2018073530 | A1 | 4/2018 |

OTHER PUBLICATIONS

The Notice of Reasons for Rejection issued in corresponding Japanese Application No. 2020-533722, mailed Jun. 18, 2021 (8 pages).

The First Office Action issued in corresponding Chinese Application No. 201880081201.5, issued Mar. 22, 2021 (12 pages).

* cited by examiner

ELECTRIC HEATING DEVICE WITH ELECTRODE HOUSING STATION

FIELD OF THE INVENTION

The invention relates to a heating device for an air-conditioning unit, comprising a docking station for the heating electrodes. The invention also relates to an air-conditioning unit comprising such a heating device. The invention relates lastly to a method for mechanically and electrically connecting the electrodes of the heating device.

The invention will be particularly applicable in the field of motor vehicles.

PRIOR ART

Electric heating devices that are intended to be integrated into vehicle air-conditioning units are known. These are either additional radiators, combined with heating radiators through which a heat transfer fluid flows, in vehicles with an internal combustion engine, or main radiators, in electric or hybrid vehicles.

Such heating devices comprise a heating body accommodating heating units that are provided with heating elements that are supplied with electric current by electrodes. For electrical safety reasons, it may be necessary to isolate the heating elements and their supply electrodes from the outside. To this end, the heating units comprise tubes inside which the heating elements and their electrodes are located, the inner surface of the tubes being provided with an electrically insulating layer in order to isolate the heating elements and their electrodes.

These heating devices comprise a distribution unit capable of controlling the current flowing in the heating units, in particular via an electronic board.

Switches for controlling the current flowing in the electrodes are soldered to this electronic board. Each switch is electrically connected to the electronic board, on the one hand, and to an electrode, on the other hand.

This dual connection is not easy to produce on production lines. In particular, keeping the switch in position in order to solder it to the electronic board is not easy to achieve, and said switch risks not being oriented exactly as it should be, and, second of all, it is all the more difficult to connect the electrodes.

Specifically, in addition to the electrical connection, there is also a mechanical connection to be produced between each switch and the electronic board, so that all of the components are correctly positioned in relation to one another both at the time of their assembly and for the entire service life of the heating device in general.

SUMMARY OF THE INVENTION

The present invention aims to overcome the various drawbacks set out above by way of a heating device allowing an electrical and mechanical connection between the heating body and the distribution unit that is simple to implement and that ensures correct positioning of all of the components at the time of connection, as well as for the entire service life of the heating device, and doing so with a limitation in terms of the relative movements between the components in order to avoid vibration problems and improve the reliability of the heating device.

This aim is achieved by virtue of a heating device for an air-conditioning unit having, as is conventional, a heating body supplied with current via a distribution unit in order to heat an airflow passing through said heating body, the heating body comprising an alignment of tubes containing:

- heating elements flowed through by said current;
- electrodes located on either side of the heating elements for their supply of electric current.

This device is mainly characterized in that the distribution unit comprises a docking station for the electrodes, said docking station having a plurality of receptacles accommodating the electrodes and in which there are means for mechanically and electrically connecting the electrodes to the distribution unit.

The main idea of this invention consists in providing a docking station, which acts as a bridge between the components belonging to the heating body and the components belonging to the distribution unit, and that have to be connected to one another. In this case, this docking station makes it possible to correctly position the electrodes in order to connect them. In addition, the docking station makes it possible to correctly position mechanical and electrical connection means, which will be described later on. The docking station thus forms a stable base, which serves as a reference for positioning the various components.

According to the various embodiments of the invention, which may be taken together or separately:

- said means for mechanically and electrically connecting the electrodes to the distribution unit consist of switches that are positioned in the receptacles, on the one hand, and fixed to an electronic current supply board belonging to the distribution unit, on the other hand: the docking station thus makes it possible to keep these switches in position, so that the mechanical and electrical connection is able to take place under optimum conditions.
- each receptacle has a central orifice through which the switch projects, said orifice being dimensioned so as to keep the switch in position when it is fixed to the electronic board.
- each switch has a first electrical connection face for connection to the electronic board, provided with at least one pin able to be soldered to the board, and a second electrical connection face for connection to the electrode, provided with a female coupling into which a male coupling of the electrode is inserted.
- each electrode has a free end on which the male coupling is located, the male couplings of the two electrodes relating to a heating element being arranged in a quincunx.
- for each heating element, the docking station has two receptacles in a quincunx matching the arrangement of the male couplings of the two corresponding electrodes.
- the male coupling of the electrode is inserted into the female coupling of the switch, said switch having at least one flexible blade able to exert a pressure on the male coupling of the electrode so as to keep it in position and create the electrical connection.
- the male coupling of the electrode consists of a tab, said switch having a plurality of flexible blades exerting pressure on either side of said tab.
- each receptacle has guide means for guiding the electrode.
- said guide means consist of two studs that are located on either side of the receptacle and whose opposing faces are beveled toward the center of the receptacle so as to form guide ramps for the electrode.
- said docking station consists of a bar extending over the entire length of the heating body, following the alignment of the electrodes.

the docking station has as many receptacles as there are electrodes in the heating body, each receptacle accommodating an electrode.

said docking station has two rows of receptacles, the receptacles of one row being offset from the receptacles of the other row.

said docking station is perforated between adjacent receptacles.

the docking station is made from electrically insulating plastic material.

the docking station has a face facing the electronic board, said face being provided with a longitudinal central rib bearing on the electronic board.

the docking station has, in addition to the rib, one or more spaces between the docking station and the electronic board, so as to allow other components to be soldered to the electronic board, underneath the docking station.

The invention also relates to an air-conditioning unit comprising a heating device as described above.

Moreover, the invention relates lastly to a method for mechanically and electrically connecting an electrode of a heating device as described above. In this case, this method comprises the following steps:

positioning the docking station so as to bear on an electronic board;

inserting switches into successive orifices provided for this purpose in the docking station, and then into the electronic board until they are held in position;

soldering the switches to the electronic board;

simultaneously threading all of the electrodes of the heating body into the corresponding switches in a single translational movement of the heating body with respect to the distribution unit.

PRESENTATION OF THE FIGURES

The invention will be better understood, and other aims, details, features and advantages thereof will become more clearly apparent from the following detailed explanatory description of at least one embodiment of the invention, which is provided by way of a purely illustrative and non-limiting example, with reference to the appended schematic drawings.

Figure 2:
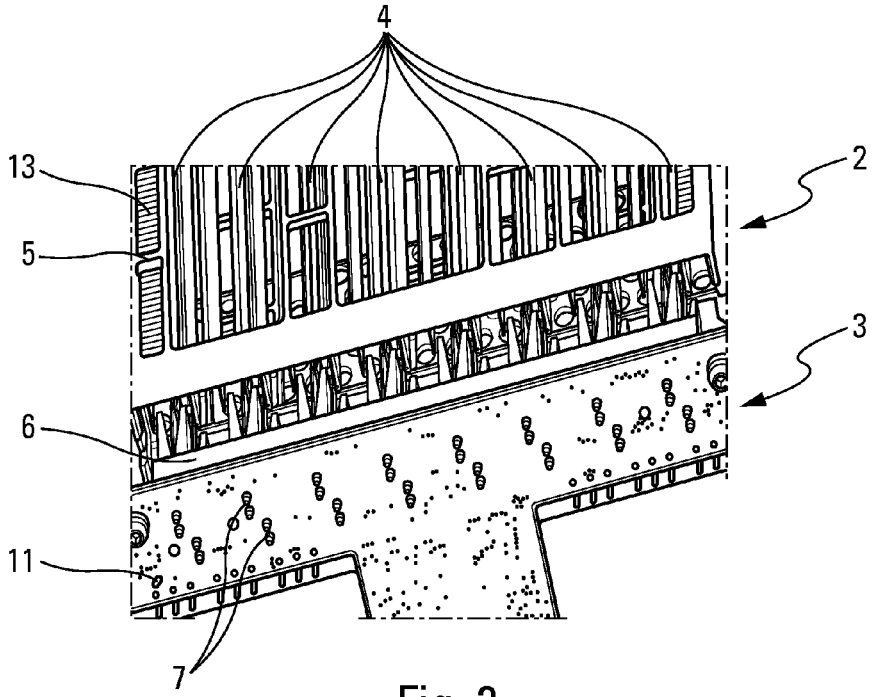
Figure 3:
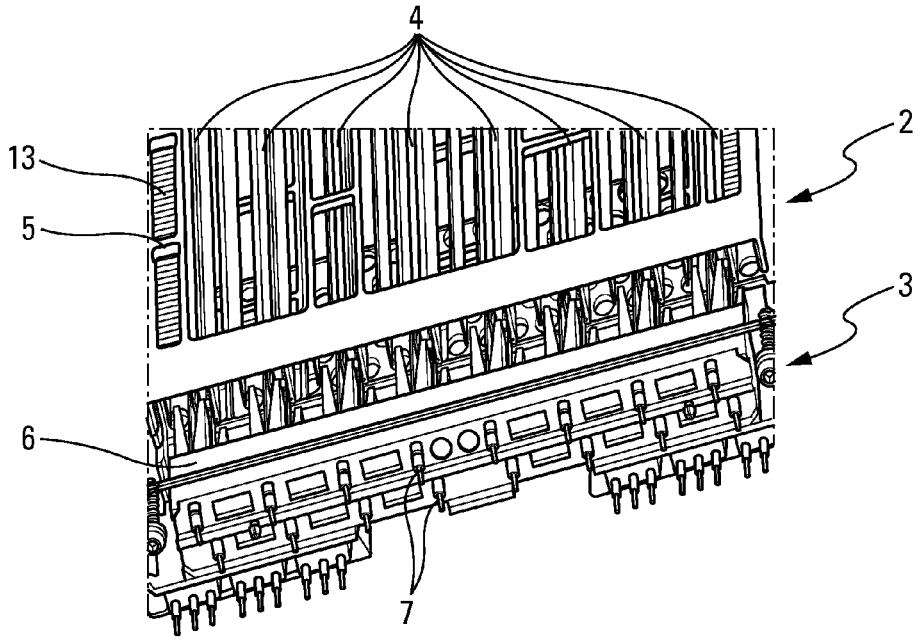
Figure 4:
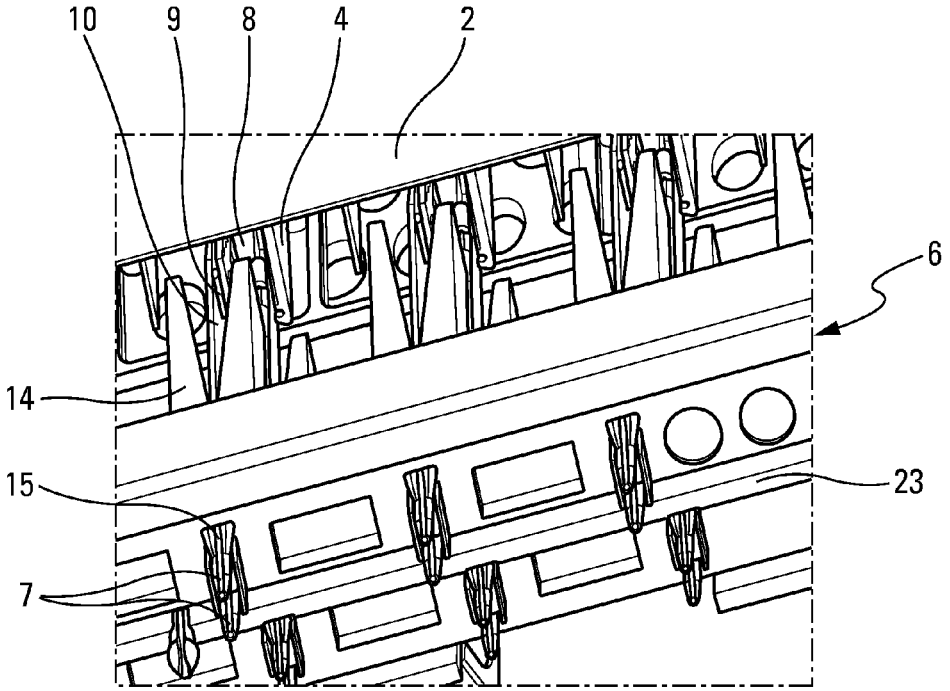
Figure 5:
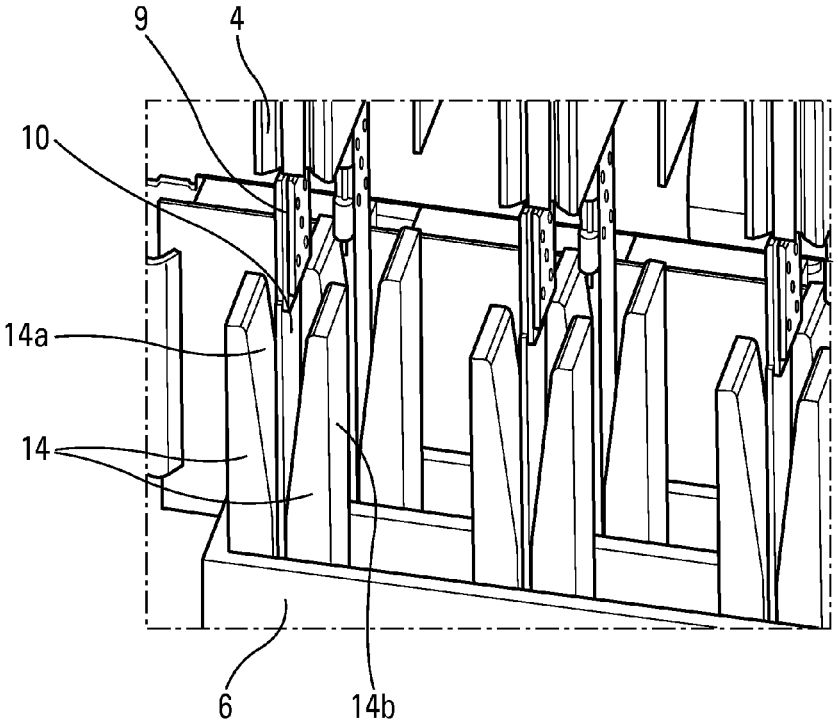
Figure 6:
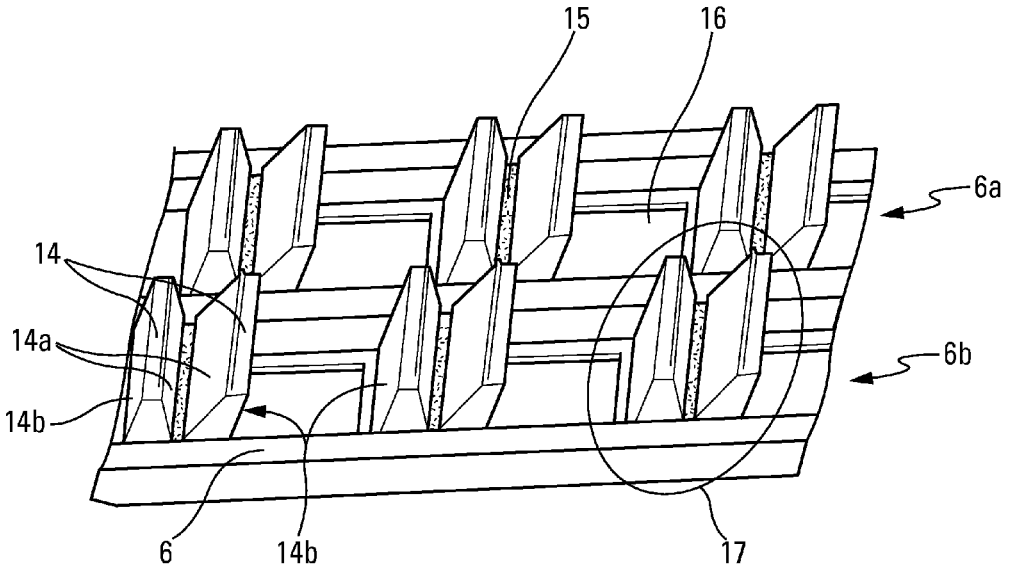
Figure 7:
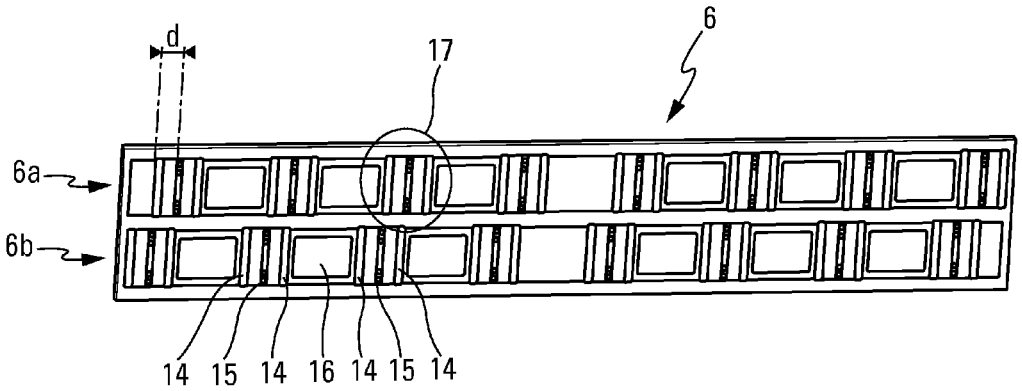
Figure 8:
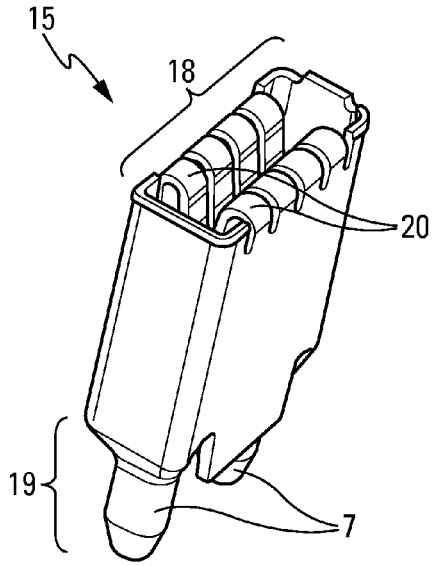
Figure 9:
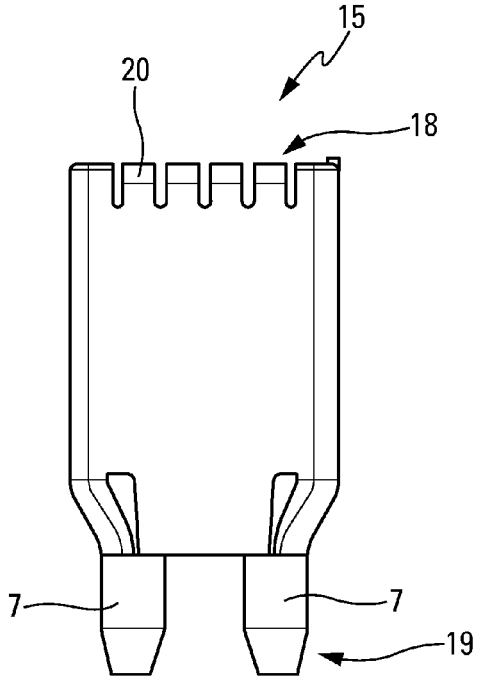
Figure 10:
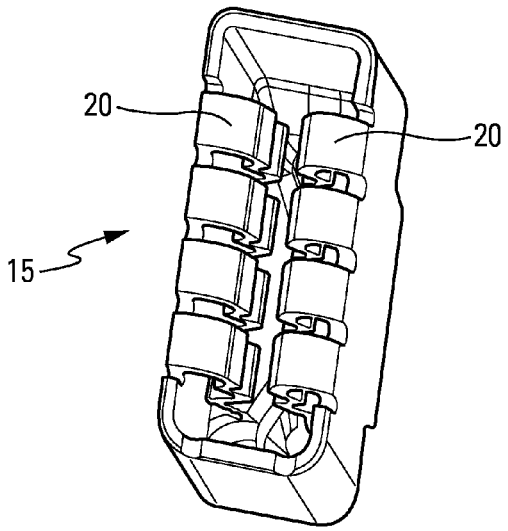
Figure 11:
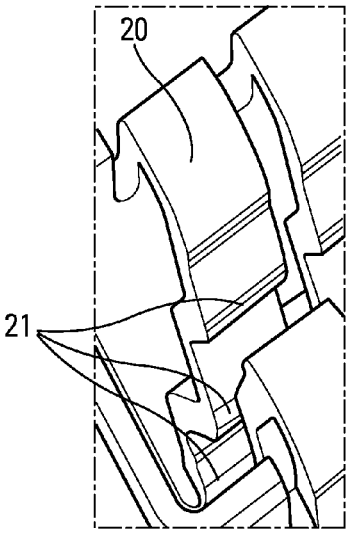
Figure 12:
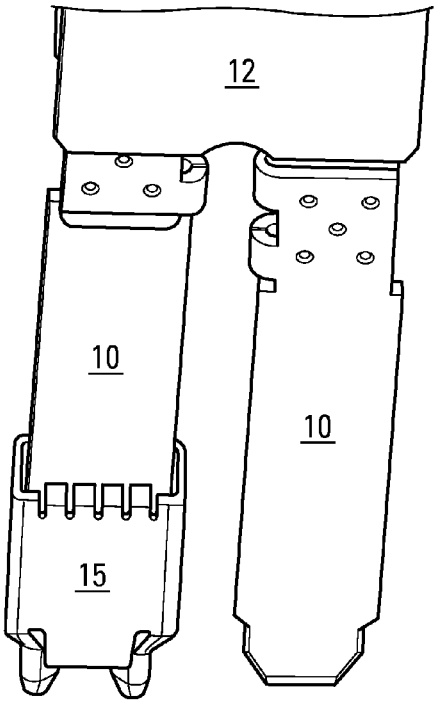
Figure 13:
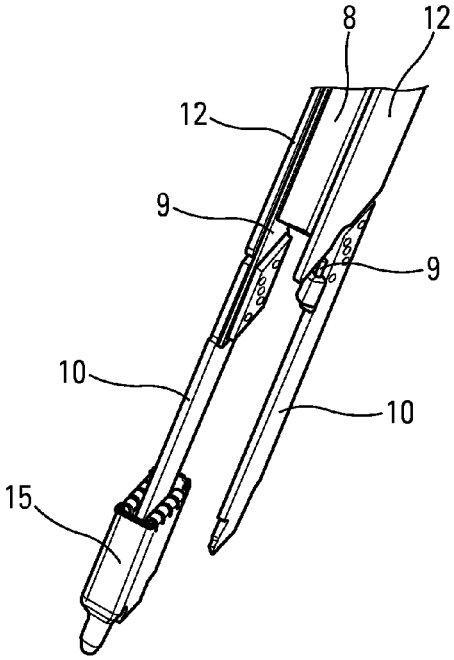
Figure 14:
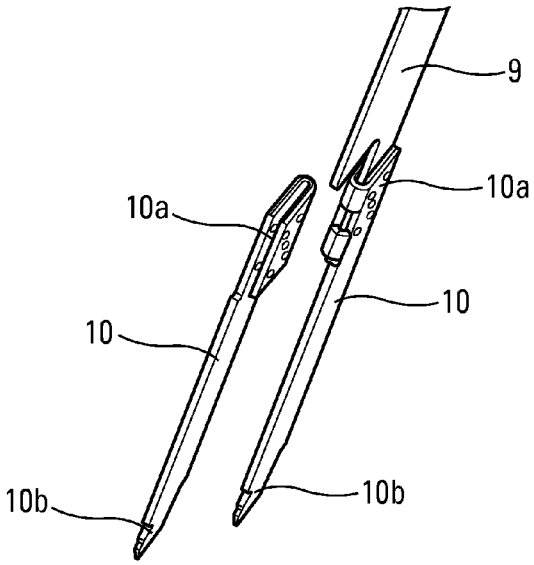

In these drawings:

FIG. 1 illustrates a heating device according to the invention in perspective, with a heating body and a distribution unit, FIG. 2 is an enlarged view of FIG. 1 showing, more particularly, the junction between the heating body and the distribution unit, FIG. 3 reproduces FIG. 2, but without an electronic board, FIG. 4 is an enlarged view of FIG. 3, showing the lower face of the docking station according to the invention, FIG. 5 shows the upper face of the docking station according to the invention in perspective, with the connection of the electrodes, FIG. 6 is a plan view of part of the docking station in perspective, FIG. 7 is a plan view of the entire docking station, FIGS. 8 to 11 illustrate a switch in detail, FIGS. 12 and 13 show the connection between an electrode and a switch in perspective, FIG. 14 illustrates a free end of an electrode according to one possible configuration in perspective.

DETAILED DESCRIPTION

With reference to FIG. 1, the invention relates to an electrical heating device 1. This is for example a heating device 1, said to be high voltage, that is to say intended to be supplied by direct current (DC) or alternating current (AC) having a voltage greater than 60 V, in particular between 60 and 1000 V, more particularly between 180 and 600 V, and/or allowing a heating power to be output into the air or a consumed electric power greater than 2 kW, in particular between 2 kW and 10 kW.

Said heating device 1 comprises a heating body 2 supplied with electric current in order to heat an airflow passing through said heating body 2.

Said heating body 2 in this case has a substantially parallelepipedal configuration extending on the surface. It is intended to be positioned transverse to the airflow to be heated. More precisely, said airflow is intended to be oriented perpendicular to said heating body 2, that is to say perpendicular to the plane of FIG. 1.

The heating body 2 is formed by a succession of aligned metal tubes 4. Inside each tube 4 are heating elements 8 that are flowed through by said current. The heating elements 8 are for example PTC (positive temperature coefficient) effect resistors. These heating elements 8 are particularly visible in FIG. 13.

Electrodes 9 are located on either side of the heating elements 8 for their supply of electric current. More particularly, each heating element 8 is surrounded by a positive electrode 9 and by a negative electrode 9.

In order to electrically insulate the tube 4 from the electrodes 9 and the heating elements 8, layers 12 of electrically insulating and thermally conductive material are located between each electrode 9 and an inner wall of the tube 4.

Each tube 4/heating elements 8/electrodes 9 assembly forms what is called a heating unit.

Said heating units are selectively supplied with current. This is understood to mean that each heating unit is supplied with current independently of the others and may therefore be flowed through by a current that is different, in particular in terms of its magnitude, from the current flowing through the other heating units. The value of the current involved in this case is in particular the value of the average current or of the effective current.

Returning to FIG. 1, the heating body 2 may comprise heat sinks 13, for example fins, in thermal contact with the tubes 4. The heat sinks 13 are in particular positioned between said tubes 4. For the sake of clarity, only some heat sinks 13 extending from the end tubes 4 have been shown, so as not to overload FIG. 1.

Said heating body 2 comprises a frame 5, in particular made of plastic, accommodating said heating units and used to hold said tubes 4. The tubes 4 are also held in position by way of intermediate plates 22.

Preferably, the heating device 1 furthermore comprises a distribution unit 3 able to control the current flowing in said heating body 2.

Said distribution unit 3 is advantageously configured so as to drive the current being supplied to the heating body 2, in particular the various heating units, in particular using driven switches 15, making it possible to control a respective flow of current in each of the heating units. These switches 15 (visible in FIG. 4) are mounted on a T-shaped electronic board 11.

FIG. 2 shows the lower face of the electronic board 11, with a plurality of pins 7 that are soldered thereto. These pins 7 belong to said switches 15.

In order to be able to correctly keep the switches 15 in place when they are fixed to the electronic board 11, a docking station 6 is provided and located just above the upper face of the electronic board 11. This docking station 6 is in particular visible in FIG. 3, in which the electronic board 11 is not shown for greater clarity.

This docking station 6 is thus arranged at the junction between the heating body 2 with its heating units, on the one hand, and the distribution unit 3 with its electronic board 11, on the other hand. The docking station 6 consists of an intermediate base that facilitates the electrical and mechanical connection of the heating body 2 to the distribution unit 3.

As may be seen in FIG. 4, this station 6 receives the electrodes 9 projecting from the tubes 4 on one side, and the switches 15 able to be soldered to the electronic board 11 on the other side.

More precisely, the docking station 6 has a lower face facing the electronic board 11, and an upper face facing the tubes 4. The docking station 6 consists of a bar, or a strip, extending over the entire length of the heating body 2, following the alignment of the electrodes 9 at the outlet of the tube 4.

This lower face is provided with a central rib 23 that is oriented longitudinally along the docking station 6. This rib 23 is able to rest on the upper surface of the electronic board 11, so as to have flat contact between the docking station 6 and the electronic board 11. This flat contact first makes it possible to position the docking station 6 above the electronic board 11 in a stable manner. Moreover, the docking station 6 makes it possible to increase the mechanical strength of the electronic board 11 according to two principles:

- by increasing the overall rigidity of the electronic board 11 by virtue of the greater moment of inertia of the electronic board 11/docking station 6 assembly;
- by also acting as a stop that limits deformation, that is to say sag, of the electronic board 11 in the event of excessively great vibration.

There is therefore a space between the docking station 6 and the electronic board 11 on either side of the rib 23. Ideally and if necessary, this space is dimensioned so as to be able to allow other components to be soldered to the electronic board 11, underneath the docking station 6.

The upper face, for its part, illustrated in FIGS. 5 to 7, has a plurality of receptacles 17 accommodating the electrodes 9 and in which there are means for mechanically and electrically connecting the electrodes 9 to the distribution unit 3, corresponding to the switches 15. Specifically, there is a central orifice into which a switch 15 is inserted inside each receptacle 17.

This switch 15 is more particularly shown in FIGS. 8 to 11. This is a conventional switch 15, with a first electrical connection face 19 for connection to the electronic board 11, provided with two pins 7 that are able to be soldered to the board 11, and with a second electrical connection face 18 for connection to the electrode 9, provided with a female coupling acting as a quick connector. Specifically, this female coupling has a plurality of flexible blades 20 able to exert pressure on the electrode 9 that penetrates into it. In this case, there are four flexible blades 20 on either side of the electrode 9 that bear thereon. Positioning the flexible blades 20 on either side of the electrode 9 makes it possible to center the electrode 9 and to keep it in the centered position, unlike a female coupling configuration where there would only be flexible blades 20 on one side of the electrode 9. In addition, as is particularly visible in FIG. 11, each flexible blade 20 has a zigzag shape, making it possible to have several bearing points 21 on the electrode 9. In particular, each zigzag point 21 bears on the electrode 9.

Returning to FIG. 6, it is clearly visible that, for each receptacle 17, guide studs 14 extend on either side of the central orifice in the direction of the tubes 4. The purpose of these studs 14 is to guide the electrode 9 until it is inserted into the switch 15.

According to one possible configuration, for each receptacle 17, the faces 14*a* of the studs located facing one another are beveled in the direction of the central orifice so as to form guide ramps for guiding the electrode 9 toward the central orifice where the switch 15 is located. These studs 14 thus form a V into which the electrode 9 is inserted. This guidance of the electrodes 9 makes it possible to improve the assembly between the heating body 2 and the distribution unit 3.

The faces 14*b* of the studs 14 that are located facing one another between two successive receptacles 17 are for their part oriented perpendicular to the docking station 6.

Generally speaking, the docking station 6 has as many receptacles 17 as there are electrodes 9 in the heating body 2, each receptacle 17 accommodating an electrode 9.

More precisely, the electrodes 9 each have a free end projecting from the tubes 4. Each free end has a male coupling 10 able to enter the female coupling of the switch 15. This male coupling 10 may be formed in one piece with the electrode 9, or may consist of a separate piece mounted on the electrode 9, as is the case in the example visible in FIGS. 13 and 14. In this case, the male coupling 10 corresponds to a tab, a first end 10*a* of which is mounted and riveted on the electrode 9 for example, and the second end 10*b* of which enters the female coupling of the switch 15.

For each heating unit, the male couplings 10 of the two electrodes 9 extend in the axial direction of the tube 4 but with a transverse offset. The male couplings 10 are thus situated in a quincunx.

Therefore, for each tube 4, the docking station 6 has two receptacles 17 in a quincunx matching the arrangement of the male couplings 10 of the two corresponding electrodes 9, one positive and the other negative. In this way, the switches 15 inserted into these receptacles 17 are placed at a distance from one another, since it is important to comply with an isolation distance between the switches 15 belonging to the positive current line and the switches 15 belonging to the negative current line.

Thus, as shown in FIG. 7, the docking station 6 has two rows 6*a*, 6*b* of receptacles 17, the receptacles 17 of one row 6*a* being offset from the receptacles 17 of the other row 6*b*. One of the rows of receptacles 17 is located on a positive current line to which the positive electrodes 9 are connected and the other row is located on a negative current line to which the negative electrodes 9 are connected.

The docking station 6 is perforated between the adjacent receptacles 17, via windows 16. This makes it possible to use a minimum amount of material and to obtain a lightweight bar.

The docking station 6 is made from an electrically insulating plastic material. Such a material also allows good resistance to temperature, flammability and humidity.

The docking station 6 is obtained by molding or by plastic injection.

Specifically, the connection between the heating body 2 and the distribution unit 3 takes place as follows.

The docking station 6 is positioned on the electronic board 11, so that its rib 23 bears on the upper surface of the board 11. When the docking station 6 and the board 11 are correctly positioned with respect to one another, the switches 15 are inserted into the receptacles 17 provided for this purpose, and more precisely into the orifices of the receptacles 17. The pins 7 of the switches 15 are then inserted into small holes provided for this purpose in the electronic board 11. The switches 15 are then in a stable position in the receptacles 17 of the docking station 6, and it is possible to solder the pins 7 to the electronic board 11.

The last step then consists in inserting the male couplings 10 of the electrodes 9 into the switches 15 of the docking station 6. This last step may be performed in a single movement, via a rectilinear translation of the heating body 2 with respect to the docking station 6, given that a switch 15 is provided facing each male coupling 10.

This single movement is in particular made possible by virtue of the guidance of the male couplings 10 via the guide studs 14 and by virtue of the quick connector provided on the first connection face 18 of the switch 15. Specifically, it is enough to slide the male coupling 10 into the first connection face 18 of the switch 15 and the flexible blades 20 create the electrical connection as well as the mechanical connection of the male coupling 10, since they exert pressure on it so as to keep it in position.

With such a connection, the movements of the electronic board 11 are greatly limited, thereby making it possible to avoid vibration problems, and to improve the reliability of the electronic board 11, and of the heating device 1 in general.

The invention also relates to an air-conditioning unit comprising a heating device 1 as described above. Said air-conditioning unit comprises a body for the flow of the airflow, inside which body said heating device 1 is located.

With regard to the above description, the optimum dimensional relationships for the parts of the invention, including variations in size, materials, shapes, function and modes of operation, assembly and use, are considered to be apparent and obvious to those skilled in the art, and all relationships equivalent to what is illustrated in the drawings and what is described in the specification are intended to be included in the present invention.

The invention claimed is:

1. A heating device for an air-conditioning unit, said heating device comprising:

a heating body supplied with current via a distribution unit to heat an airflow passing through said heating body, the heating body comprising an alignment of tubes containing:

heating elements flowed through by said current;

electrodes located on either side of the heating elements for their supply of electric current;

said distribution unit comprising a docking station for the electrodes, said docking station having a plurality of receptacles accommodating the electrodes and in which there are means for mechanically and electrically connecting the electrodes to the distribution unit;

wherein said means for mechanically and electrically connecting the electrodes to the distribution unit consists of switches that are positioned in the receptacles and fixed to an electronic current supply board belonging to the distribution unit;

the docking station further comprising:

a lower face facing the electronic current supply board, and an upper face facing the tubes, and wherein each switch has a first electrical connection face for connection to the electronic board, provided with at least one pin able to be soldered to the board, and a second electrical connection face for connection to the electrode, provided with a female coupling into which a male coupling of the electrode is inserted.

2. The heating device as claimed in claim 1, wherein each receptacle has a central orifice through which the switch projects, said orifice being dimensioned so as to keep the switch in position when it is fixed to the electronic board.

3. The heating device as claimed in claim 2, wherein each electrode has a free end on which the male coupling is located, the male couplings of the two electrodes relating to a heating element being arranged in a quincunx.

4. The heating device as claimed in claim 3, wherein, for each heating element, the docking station has two receptacles in a quincunx matching the arrangement of the male couplings of the two corresponding electrodes.

5. The heating device as claimed in claim 2 the male coupling of the electrode is inserted into the female coupling of the switch, said switch having at least one flexible blade able to exert a pressure on the male coupling of the electrode so as to keep it in position and create the electrical connection.

6. The heating device as claimed in claim 1, wherein each receptacle has guide means for guiding the electrode.

7. The heating device as claimed in claim 6, wherein said guide means consist of two studs that are located on either side of the receptacle and whose opposing faces are beveled toward a center of the receptacle so as to form guide ramps for the electrode.

8. The heating device as claimed in claim 1, wherein said docking station consists of a bar extending over an entire length of the heating body, following the alignment of the electrodes.

9. The heating device as claimed in claim 1, wherein the docking station has as many receptacles as there are electrodes in the heating body, each receptacle accommodating an electrode.

10. The heating device as claimed in claim 1, wherein said docking station has two rows of receptacles, the receptacles of one row being offset from the receptacles of the other row.

11. The heating device as claimed in claim 1, wherein the docking station has a face facing the electronic board, said face being provided with a longitudinal central rib bearing on the electronic board.

12. The heating device as claimed in claim 1, wherein the docking station has, in addition to a rib, one or more spaces between the docking station and the electronic board, so as to allow other components to be soldered to the electronic board, underneath the docking station.

13. An air-conditioning unit comprising:

a heating device comprising:

a heating body supplied with current via a distribution unit to heat an airflow passing through said heating body, the heating body comprising an alignment of tubes containing heating elements flowed through by said current and electrodes located on either side of the heating elements for their supply of electric current, said distribution unit comprising a docking station for the electrodes, said docking station having a plurality of receptacles accommodating the electrodes and in which there are means for mechanically and electrically connecting the electrodes to the distribution unit, wherein said means for mechanically and electrically connecting the electrodes to the distribution unit consists of switches that are positioned in the receptacles and fixed to an electronic current supply board belonging to the distribution unit;

the docking station further comprising:

a lower face facing the electronic current supply board, and an upper face facing the tubes; and wherein each switch has a first electrical connection face for connection to the electronic board, provided with at least one pin able to be soldered to the board, and a second electrical connection face for connection to the electrode, provided with a female coupling into which a male coupling of the electrode is inserted.

14. A method for mechanically and electrically connecting electrodes of a heating device comprising:

a heating body supplied with current via a distribution unit to heat an airflow passing through said heating body, the heating body comprising an alignment of tubes containing heating elements flowed through by said current and electrodes located on either side of the heating elements for their supply of electric current, said distribution unit comprising a docking station for the electrodes, said docking station having a plurality of receptacles accommodating the electrodes and in which there are means for mechanically and electrically connecting the electrodes to the distribution unit, wherein said means for mechanically and electrically connecting the electrodes to the distribution unit consists of switches that are positioned in the receptacles and fixed to an electronic current supply board belonging to the distribution unit; and the docking station further comprising:

a lower face facing the electronic current supply board, and an upper face facing the tubes, wherein each switch has a first electrical connection face for connection to the electronic board, provided with at least one pin able to be soldered to the board, and a second electrical connection face for connection to the electrode, provided with a female coupling into which a male coupling of the electrode is inserted;

the method comprising:

positioning the docking station so as to bear on an electronic board;

inserting the switches into successive orifices provided for this purpose in the docking station, and then into the electronic board until they are held in position;

soldering the switches to the electronic board; and simultaneously threading all of the electrodes of the heating body into the corresponding switches in a single translational movement of the heating body with respect to the distribution unit.

15. A heating device for an air-conditioning unit, said heating device comprising:

a heating body supplied with current via a distribution unit to heat an airflow passing through said heating body, the heating body comprising an alignment of tubes containing: heating elements flowed through by said current;

electrodes located on either side of the heating elements for their supply of electric current;

said distribution unit comprising a docking station for the electrodes, said docking station having a plurality of receptacles accommodating the electrodes and in which there are means for mechanically and electrically connecting the electrodes to the distribution unit;

wherein said means for mechanically and electrically connecting the electrodes to the distribution unit consists of switches that are positioned in the receptacles and fixed to an electronic current supply board belonging to the distribution unit, and the docking station further comprising:

a lower face facing the electronic current supply board, and an upper face facing the tubes, and wherein the docking station has a face facing the electronic current supply board, said face being provided with a longitudinal central rib bearing on the electronic current supply board.

* * * * *